US009982558B2

(12) United States Patent
Katagake

(10) Patent No.: US 9,982,558 B2
(45) Date of Patent: May 29, 2018

(54) STEAM TURBINE

(71) Applicant: MITSUBISHI HEAVY INDUSTRIES COMPRESSOR CORPORATION, Tokyo (JP)

(72) Inventor: Makoto Katagake, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 435 days.

(21) Appl. No.: 14/777,982

(22) PCT Filed: Mar. 22, 2013

(86) PCT No.: PCT/JP2013/058377
§ 371 (c)(1),
(2) Date: Sep. 17, 2015

(87) PCT Pub. No.: WO2014/147832
PCT Pub. Date: Sep. 25, 2014

(65) Prior Publication Data

US 2016/0069206 A1 Mar. 10, 2016

(51) Int. Cl.
*F01D 17/18* (2006.01)
*F01D 17/14* (2006.01)
(Continued)

(52) U.S. Cl.
CPC ..... *F01D 17/18* (2013.01); *F01D 17/145* (2013.01); *F01D 21/006* (2013.01); *F01D 17/24* (2013.01);
(Continued)

(58) Field of Classification Search
CPC ..... F01D 17/18; F01D 17/145; F01D 17/24; F01D 21/006; F01D 21/14; F05D 2230/31; F05D 2260/90; F05D 2270/09
See application file for complete search history.

(56) References Cited

U.S. PATENT DOCUMENTS 5,333,989 A * 8/1994 Missana ..... F01D 17/10 251/129.04
5,832,944 A 11/1998 Lindner
(Continued)

FOREIGN PATENT DOCUMENTS

JP 51-117207 A 10/1976
JP 07-019006 1/1995
JP 8-200009 A 8/1996
JP H08-232607 A 9/1996
(Continued)

OTHER PUBLICATIONS

International Search Report, dated Jun. 11, 2013, in related application No. PCT/JP2013,058377.
(Continued)

*Primary Examiner* — Richard Edgar
(74) *Attorney, Agent, or Firm* — Birch, Stewart, Kolasch & Birch, LLP

(57) ABSTRACT

A steam turbine includes a turbine body; a steam flow passage; a regulating valve which regulates opening and closing of the steam flow passage with a linear motion; a switching drive mechanism which drives the regulating valve; an electronic governor which controls at least the switching drive mechanism; and a controller unit. The switching drive mechanism has an electric motor which rotates when supplied with power, a conversion mechanism which converts a rotary motion of the electric motor into a linear motion of the regulating valve, and a brake which brakes the rotary motion of the electric motor. At least one of the controller unit and the electronic governor performs control such that the brake is actuated and the position of the regulating valve is maintained when at least one of the electric motor and the controller unit breaks down.

20 Claims, 9 Drawing Sheets

(51) Int. Cl.

| | |
|---|---|
| ***F01D 21/00*** | (2006.01) |
| *F01D 17/24* | (2006.01) |
| *F01D 21/14* | (2006.01) |

(52) U.S. Cl.

CPC ..... *F01D 21/14* (2013.01); *F05D 2220/31* (2013.01); *F05D 2260/90* (2013.01); *F05D 2270/09* (2013.01)

(56) References Cited

U.S. PATENT DOCUMENTS

| | | | |
|---|---|---|---|
| 6,485,258 | B1 | 11/2002 | Steinborn |
| 2006/0016281 | A1 | 1/2006 | Donald et al. |
| 2007/0075285 | A1 | 4/2007 | Lovejoy |

FOREIGN PATENT DOCUMENTS

| | | | |
|---|---|---|---|
| JP | 2000-161010 | A | 6/2000 |
| JP | 2002-2507711 | A | 3/2002 |
| JP | 2005-106062 | A | 4/2005 |
| JP | 2007-89374 | A | 4/2007 |
| JP | 2010-106999 | A | 5/2010 |

OTHER PUBLICATIONS

Written Opinion, dated Jun. 11, 2013, in related application No. PCT/JP2013,058377.

Chinese Office Action dated Feb. 3, 2016 issued in counterpart Chinese Application No. 201380074715.5 with an English Translation of the Search Report.

Office Action dated Jun. 28, 2016 in corresponding Japanese Application No. 2015-506519 with an English Translation.

* cited by examiner

STEAM TURBINE

TECHNICAL FIELD

The present invention relates to a steam turbine which is rotationally driven by steam.

BACKGROUND ART

A steam turbine is used to drive a machine and is provided with a turbine body having a rotatably supported rotor. The rotor is rotationally driven by supply of the steam as a working fluid to the turbine body. In the steam turbine, the steam supplied to the turbine body or the steam extracted from the turbine body flows through a steam flow passage. A regulating valve is provided in the steam flow passage, and a switching drive mechanism having a regulating valve regulates the opening and closing of the steam flow passage to regulate the flow rate of steam (e.g., see Patent Literature 1).

Moreover, the regulating valve is generally driven using a structure which opens and closes the regulating valve via a lever, to which one end of the regulating valve is fixed, using a hydraulic servo mechanism. Meanwhile, a structure which operates the lever using an electric actuator for the purpose of saving space is also known.

Moreover, as a function of a double safety device (Fail safe), a function of operating the lever, for example, using a biasing force of a tension coil spring to forcibly close the regulating valve during power failure and during breakdown of an electronic governor which controls the switching drive mechanism is also known.

CITATION LIST

Patent Literature

[Patent Literature 1]
Japanese Unexamined Patent Application, First Publication No. 7-19006

SUMMARY OF INVENTION

Technical Problem

However, when the operation of the steam turbine is stopped due to the breakdown of an electric actuator and a controller unit attached to the electric actuator, it is necessary to restart the steam turbine. Since stop and restart of the steam turbine require a large amount of time and money, there is a desire for a system in which the steam turbine do not need to be stopped even when the electric actuator and the controller unit break down.

The present invention provides a steam turbine in which the operation of the steam turbine is not stopped even when the electric actuator or the controller breaks down.

Solution to Problem

According to a first aspect of the invention, there is provided a steam turbine which includes a turbine body having a rotatably supported blade, a steam flow passage which is connected to the turbine body and through which steam flows as a working fluid, a regulating valve which regulates the opening and closing of the steam flow passage with a linear motion, a switching drive mechanism which drives the regulating valve, an electronic governor which controls at least the switching drive mechanism, and a controller unit which controls the operation of the switching drive mechanism, wherein the switching drive mechanism includes an electric motor which rotates when supplied with power, a conversion mechanism which converts a rotary motion of the electric motor into a linear motion of the regulating valve, and a brake which brakes the rotary motion of the electric motor, and at least one of the controller unit and the electronic governor performs control such that the brake is actuated and the rotary motion of the electric motor is braked to maintain the position of the regulating valve, when at least one of the electric motor and the controller unit breaks down.

According to the configuration, since the valve opening degree of the regulating valve is maintained even when the electric motor and the controller unit break down, it is possible to operate a steam turbine without stopping the operation of the steam turbine.

In the steam turbine, the brake is configured to be supplied with power by the uninterruptible power supply and to be actuated by cutoff of the power supplied to the brake to brake the rotary motion of the electric motor, and at least one of the controller unit and the electronic governor cuts off the power supplied to the brake when at least one of the electric motor and the controller unit breaks down.

According to the configuration, since the power of the brake is supplied to the uninterruptible power supply, it is possible to prevent the brake from being erroneously operated due to power failure.

The steam turbine includes a limit sensor which detects driving of the regulating valve in excess of a predetermined range, at least one of the controller unit and the electronic governor performs control of actuating the brake and braking the rotary motion of the electric motor to maintain the position of the regulating valve when the limit sensor detects driving of the regulating valve in excess of a predetermined range.

According to the configuration, when the regulating valve is driven to a planned value or higher due to the control abnormality of the controller unit, it is possible to prevent the excess steam from flowing into the turbine body.

In the steam turbine, it is preferable to include a limit member which mechanically limits the driving of the regulating valve.

According to the configuration, when the regulating valve is driven to a planned value or higher due to the control abnormality of the controller unit, it is possible to prevent the excess steam from flowing into the turbine body.

In the steam turbine, the conversion mechanism preferably includes a ball screw which is rotationally driven by the electric motor, and a nut which is screwed to the ball screw and connected to the regulating valve.

According to the configuration, the nut screwed to the ball screw moves linearly along the ball screw along with the rotation of the ball screw, and the regulating valve connected to the nut also moves linearly. Thus, by the simple configuration such as the ball screw and nut, it is possible to convert the rotary motion of the electric motor into a linear motion of the regulating valve. Moreover, by the simple configuration of the switching drive mechanism, it is possible to reduce the installation space.

The steam turbine preferably further includes a spare controller unit which controls the operation of the switching drive mechanism when the controller unit breaks down.

According to the configuration, even when the controller unit breaks down, since the spare controller unit controls the operation of the switching drive mechanism in place of the controller unit, it is possible to perform the continuous operation of the steam turbine. This allows reliable operation of the steam turbine.

The steam turbine preferably further includes a spare switching drive mechanism which drives the regulating valve when the switching drive mechanism breaks down.

According to the configuration, even when the switching drive mechanism breaks down, since the spare switching drive mechanism controls the regulating valve in place of the switching drive mechanism, it is possible to perform the continuous operation of the steam turbine. This allows the reliable operation of the steam turbine.

In the steam turbine, breakdown of at least one of the electric motor and the controller unit is preferably detected by the electronic governor.

Advantageous Effects of Invention

According to the present invention, since the valve opening degree of the regulating valve is maintained even when the electric motor and the controller unit break down, it is possible to operate a steam turbine without stopping the operation of the steam turbine.

DESCRIPTION OF EMBODIMENTS

First Embodiment

Figure 1:
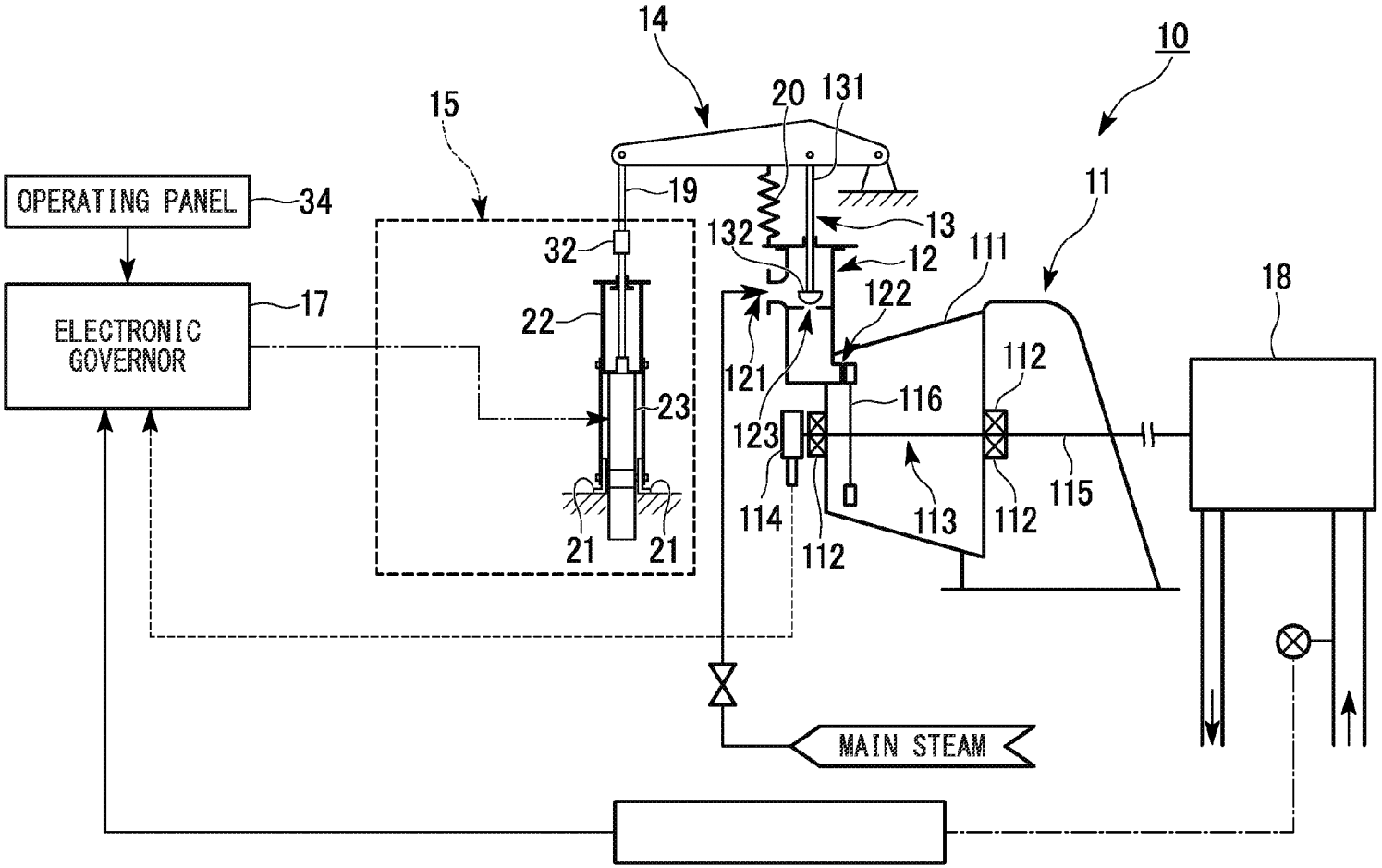
FIG. 1 is a schematic diagram showing a configuration of a steam turbine according to a first embodiment of the present invention.

A steam turbine of the first embodiment of the present invention will be described with reference to the drawings. FIG. 1 is a schematic diagram showing a configuration of a steam turbine 10 of the first embodiment.

As shown in FIG. 1, the steam turbine 10 of this embodiment includes a turbine body 11, a steam flow passage 12 through which steam flows as a working fluid, a regulating valve 13, a lever member 14, a switching drive mechanism 15, a lock mechanism 16 (shown in FIGS. 4 and 6), and an electronic governor 17 which controls the switching drive mechanism 15.

(Turbine Body)

The turbine body 11 has a cylindrical casing 111, a bearing 112 provided on the casing 111, a rotor 113 which is rotatably supported by the bearing 112 and is disposed inside the casing 111, and a speed detection sensor 114 which detects the rotational speed of the rotor 113. And, a blade 116 is fixed to the rotor 113. The blade 116 thus configured is rotated by the steam, and the compressor 18 is driven by the rotational force.

(Steam Flow Passage)

The steam flow passage 12 is a flow passage which supplies the steam to the turbine body 11. The steam is introduced into the steam flow passage 12 from a steam introduction port 121, and the steam supply port 122 is connected to the turbine body 1. A throttle hole 123 with a narrow flow passage width is provided between the steam introduction port 121 and the steam supply port 122.

Further, although a flow passage through which the steam supplied to the turbine body 11 flows is described in this embodiment as an example of the "steam flow passage" of the present invention, the steam flow passage 12 is not limited thereto and, for example, may be a steam flow passage through which the steam extracted from the turbine body 11 flows.

(Regulating Valve)

The regulating valve 13 is a valve which regulates the amount of steam supplied to the turbine body 11. The regulating valve 13 is configured such that a substantially semicircular regulating valve member 132 is provided at one end portion of a rod-shaped arm member 131, and the other end portion of the arm member 131 is fixed to a longitudinally intermediate portion of the lever member 14. According to the regulating valve 13 thus configured, as the arm member 131 moves linearly along the steam flow passage 12, the regulating valve member 132 of its leading end portion is fitted to or separated from the throttle hole 123 of the steam flow passage 12. Thus, the opening diameter of the throttle hole 123 varies, and the flow rate of the steam supplied to the turbine body 11 via the throttle hole 123 varies.

Hereinafter, the separation of the regulating valve member 132 of the regulating valve 13 from the throttle hole 123 of the steam flow passage 12 is referred to as lift, a maximum lift amount of the planned value of the switching drive mechanism is set to 100%, and a state in which the sealing member 132 of the regulating valve is fitted to the throttle hole 123 is set to a lift amount of 0%.

(Lever Member)

The lever member 14 is a member which transmits the output of the switching drive mechanism 15 to the regulating valve 13. A longitudinally proximal end portion of the lever member 14 is rotatably supported, and one end portion of the lever side rod 19 is fixed to its longitudinally leading end portion. In addition, the other end portion of an arm member 131 forming the regulating valve 13 is fixed to the longitudinally intermediate portion of the lever member 14 as described above. Furthermore, one end of a tension spring 20 is attached to the leading end side of the fixing position of the arm member 131 in the lever member 14 as a forced closing means which forcedly closes the regulating valve 13. The tension spring 20 is immovably fixed at the other end, and applies tensile force in a direction which rotates the lever member 14 in a counterclockwise direction in FIG. 1 in a state in which no external force is applied.

(Switching Drive Mechanism)

The switching drive mechanism 15 is a mechanism which drives the regulating valve 13. The switching drive mechanism 15 has a pair of fixedly installed brackets 21, a holding member 22 which is rotatably supported by the brackets 21, and an electric actuator 23 which is held by the holding member 22.

Figure 2:
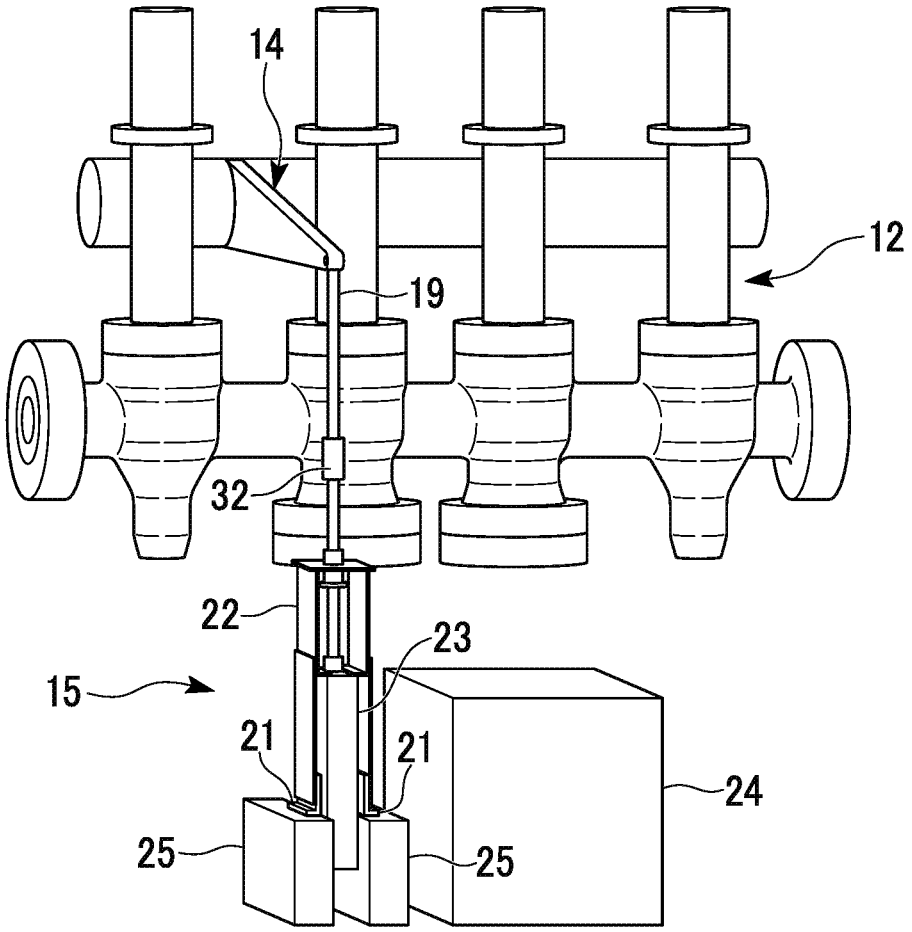
FIG. 2 is a schematic perspective view showing the periphery of a switching drive mechanism.

FIG. 2 is a schematic perspective view showing the periphery of the switching drive mechanism 15. Further, FIG. 2 does not show the turbine body 11 and the like. The pair of brackets 21 forming the switching drive mechanism 15 have a substantially L-shaped cross-section and are fixedly installed on a pedestal 25 which is provided in proximity to the bearing cover 24. Here, the bearing cover 24 houses a bearing 112 which rotatably supports the rotor 113 shown in FIG. 1.

The holding member 22 fainting the switching drive mechanism 15 is a member which holds the electric actuator 23. As shown in FIGS. 1 and 2, the holding member 22 has substantially a U shape in a side view, and is rotatably supported by the pair of holding members 22.

Figure 3:
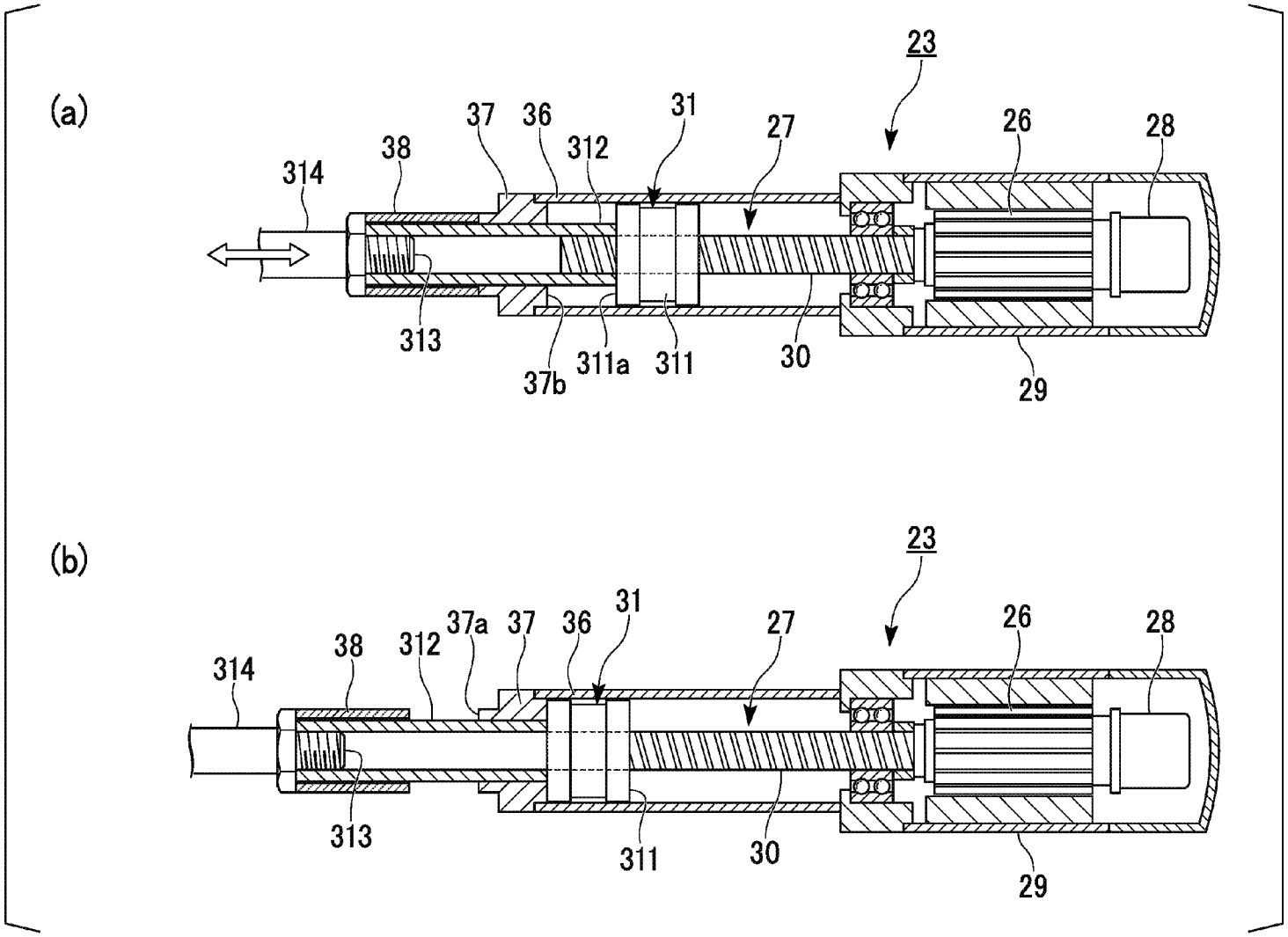
FIG. 3 is a schematic cross-sectional view showing an internal configuration of an electric actuator.

The electric actuator 23 forming the switching drive mechanism 15 generates a driving force for driving the regulating valve 13. FIG. 3 is a schematic cross-sectional view showing an internal configuration of the electric actuator 23. As shown in FIGS. 3(*a*) and 3(*b*), the electric actuator 23 includes an electric motor 26, a conversion mechanism 27 and a brake 28.

The electric motor 26 rotates by receiving the supply of electric power. The electric motor 26 is provided at a proximal end portion of the electric actuator 23 and is housed in a motor housing section 29 whose interior is hermetically sealed. Thus, since the electric motor 26 is isolated from the oil in the periphery, it is possible to provide an explosion-proof structure.

The conversion mechanism 27 is a mechanism which converts the rotary motion of the electric motor 26 into the linear motion of the regulating valve 13. The conversion mechanism 27 includes a ball screw 30 connected to a drive shaft of the electric motor 26, and a piston unit 31 which is moved forward and backward by the rotation of the ball screw 30.

The ball screw 30 is a long screw member, and a male screw is cut on its outer circumferential surface. Moreover, one end portion of the ball screw 30 is connected to the drive shaft of the electric motor 26, and the ball screw 30 is rotationally driven with the rotation of the electric motor 26.

The piston unit 31 reciprocates along the ball screw 30. The piston unit 31 includes a nut 311 which is a member having an approximately annular shape, has a female screw cut on the inner circumferential surface and is screwed to the ball screw 30; a cylindrical piston rod 312 which is fixed to one end surface of the nut 311 to cover the outer side of the ball screw 30; a rod end connector 313 which is fitted to and mounted on the leading end portion of the piston rod 312; and an actuator side rod 314 fixed to the rod end connector 313 at one longitudinal end portion.

According to the piston unit 31 thus configured, when the ball screw 30 rotates about the axis, as shown in FIG. 3(*b*), the nut 311 screwed to the ball screw 30 moves along the axis, and along with this movement, the piston rod 312, the rod end connector 313 and the actuator side rod 314 fixed to the nut 311 also move along the axis of the ball screw 30 together with the nut 311. An outer shape of the head section 313*a* of the rod end connector 313 is formed so as to be larger than the piston rod 312.

The brake 28 is an electromagnetic disc brake which is provided at a position on an opposite side to the ball screw 30 with the electric motor 26 interposed therebetween. The brake 28 is actuated by the cutoff of the power supply and brakes the rotation of the electric motor 26. That is, in a state in which the power is supplied to the brake 28, the brake 28 does not operate, and the rotation of the electric motor 26 is not obstructed.

Further, the piston unit 31 is covered by the piston casing 36, a piston cap 37 is installed at the upper end of the piston casing 36, and the piston cap 37 seals the piston casing 36 and guides the piston rod 312.

(Limit Member)

A stopper 38 having a cylindrical shape is attached to a surface of the piston rod 312 side of the head section 313*a* of the rod end connector 313 to surround the piston rod 312.

The stopper 38 functions as a limit member which mechanically limits the driving of the electric actuator 23, and when the regulating valve 13 is in the closed state (lift amount 0%), the stopper 38 of this embodiment is set such that the lower end of the stopper 38 comes into contact with an upper surface 37*a* of the piston cap 37.

In addition, the piston cap 37 also functions as a limit member. That is, the piston cap 37 is formed such that the upper surface 311*a* of the nut 311 comes into contact with the lower face 37*b* of the piston cap 37 in the open state in which the lift amount of the regulating valve 13 is 100%.

Figure 4:
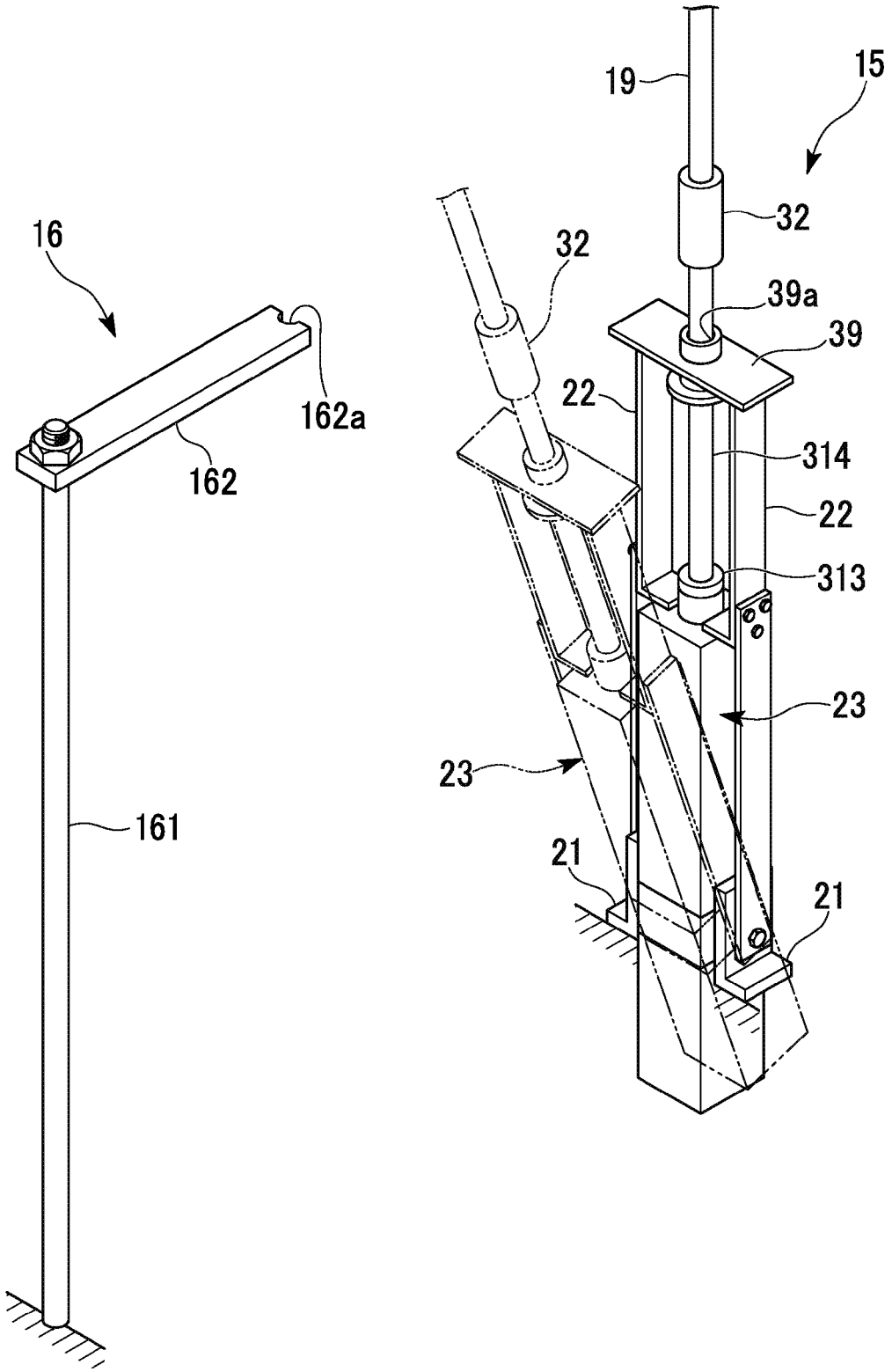
FIG. 4 is a schematic perspective view showing the periphery of the electric actuator.

FIG. 4 is a schematic perspective view showing the periphery of the electric actuator 23. The electric actuator 23 configured as described above is fixed to the holding member 22, and the actuator side rod 314 is inserted into the holding member 22. Specifically, the actuator side rod 314 is inserted into an insertion hole 39*a* provided in a guide plate 39 provided in the upper end portion of the holding member 22. Moreover, the actuator side rod 314 is connected to the lever side rod 19 via a coupling 32. As indicated by a broken line in FIG. 4, the electric actuator 23 thus installed is in a state in which slight rotation is permitted based on a position as a supporting point in which the bracket 21 supports the holding member 22.

Figure 5:
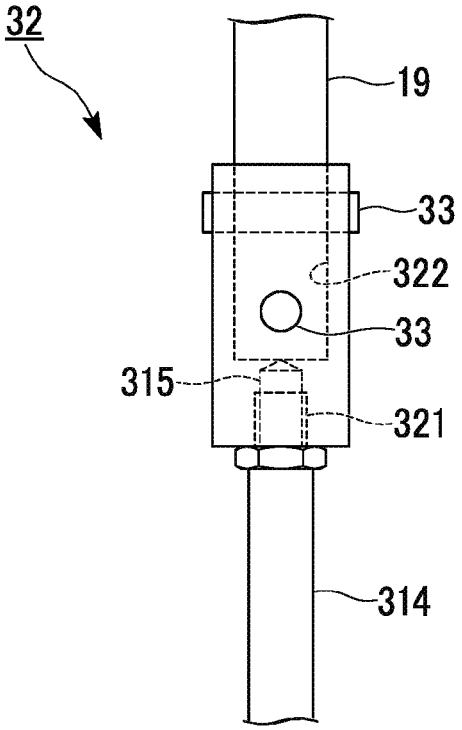
FIG. 5 is a schematic front view showing the configuration of a coupling.

FIG. 5 is a schematic front view showing the configuration of the coupling 32. The coupling 32 is a substantially cylindrical member, a screw hole 321 is formed on one end surface thereof, and a rod insertion hole 322 is formed on the other end surface thereof. Moreover, when a fixing bolt 315 attached to the actuator side rod 314 is screwed to the screw hole 321 of the coupling 32, the coupling 32 and the actuator side rod 314 are connected to each other. Meanwhile, when the lever side rod 19 is inserted into the rod insertion hole 322 of the coupling 32 and two pins 33 perpendicular to each other are inserted, the coupling 32 and the lever side rod 19 are connected to each other. Thus, the actuator side rod 314 and the lever side rod 19 are connected to each other via the coupling 32. Furthermore, by detaching each of the two pins 33, the lever side rod 19 can be pulled out of the rod insertion hole 322, thereby making it possible to release the connection between the actuator side rod 314 and the lever side rod 19.

(Lock Mechanism)

Figure 6:
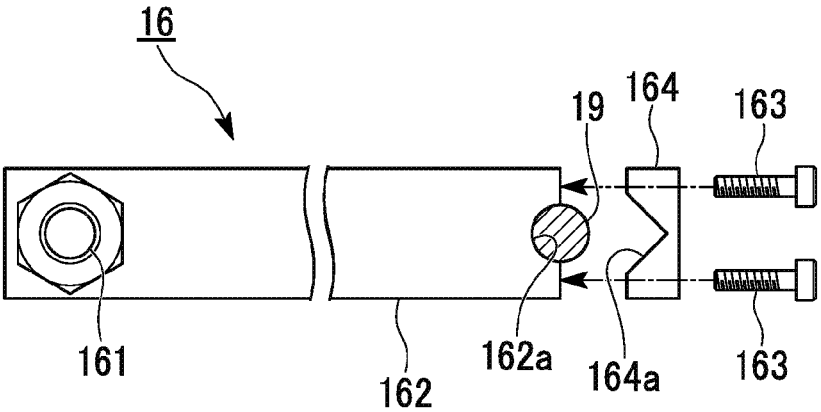
FIG. 6 is a schematic plan view showing the configuration of a lock mechanism.

The lock mechanism 16 is a mechanism which immovably locks the regulating valve 13. Here, FIG. 6 is a schematic plan view showing the configuration of the lock mechanism 16. As shown in FIGS. 4 and 6, the lock mechanism 16 has a support rod 161 which has a fixed lower end portion and extends upward, a holding plate 162 which is supported by the support rod 161 and extends in the horizontal direction, a pressing member 164 which is attachable to and detachable from the leading end portion of the holding plate 162 via a pair of fixing bolts 163. Here, as shown in FIG. 4, a fitting groove 162*a* having a substantially semicircular shape in a plan view is formed at the leading end portion of the holding plate 162. Meanwhile, a notch 164*a* having a substantially triangular shape in a plan view is formed on the side facing the holding plate 162 in the pressing member 164.

According to the lock mechanism 16 thus configured, after fitting the lever side rod 19 to the fitting groove 162*a* of the holding plate 162, the pressing member 164 is fixed to the leading end portion of the holding plate 162 using the fixing bolt 163. Thus, the lever side rod 19 is immovably locked by being interposed between the holding plate 162 and the pressing member 164.

(Limit Switch Unit)

Figure 7:
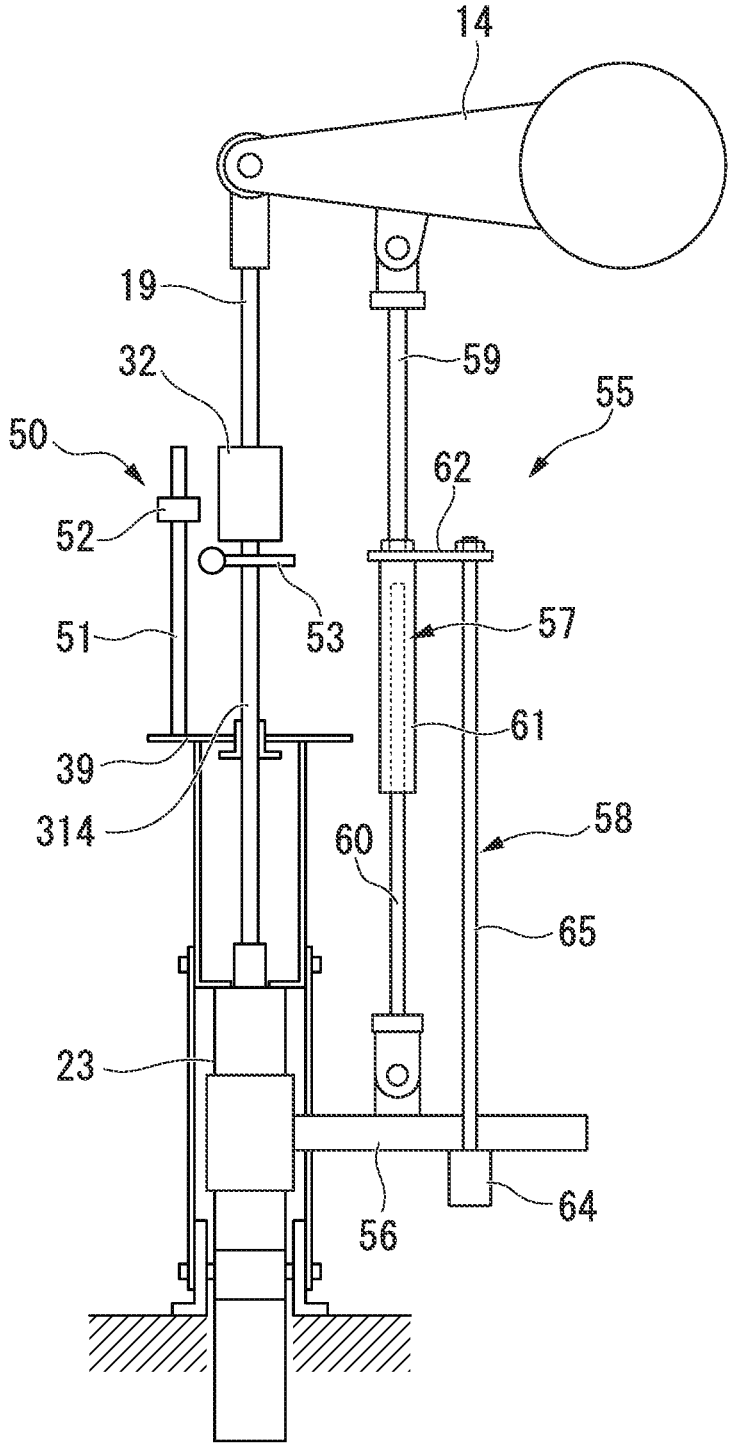
FIG. 7 is a schematic front view showing the configuration of a limit switch unit and a lift amount detector.

As shown in FIG. 7, a limit switch unit 50 is attached to the guide plate 39 of the holding member 22, and the limit switch unit 50 functions as a limit sensor which detects driving of the regulating valve 13 in excess of a predetermined range. The limit switch unit 50 is configured to include a stay 51 which is orthogonal to the guide plate 39 and extends in the longitudinal direction of the electric actuator 23, and a limit switch 52 mounted at a predetermined position of the stay 51. Further, in the vicinity of the connection portion with the coupling 32 on the actuator side rod 314, a contact bracket 53 capable of coming into contact with the limit switch 52 is mounted.

The limit switch unit 50 is set so that the switch is input when the regulating valve 13 exceeds the lift amount of 100% and becomes a lift amount of 105% when the regulating valve 13 is driven by the electric actuator 23. That is, the limit switch unit 50 is set to be turned ON when the regulating valve 13 reaches the lift amount equal to or higher than the planned value of the electric actuator 23. The limit switch unit 50 is connected to the electronic governor 17, and the electronic governor 17 is in communication with the limit switch unit 50 to perform monitoring of whether the lift amount of the regulating valve 13 is 105% or higher.

(Lift Amount Detector)

The switching drive mechanism 15 is provided with a lift amount detector 55 which serves as a limit sensor. The lift amount detector 55 has a support member 56 attached to the motor housing section 29 of the electric actuator 23, a telescopic bar 57 which connects the support member 56 with the lever member 14, and a lift sensor 58 which measures the vertical displacement of the portion that moves upward along with the rotational movement of the lever member 14 of the telescopic bar 57.

The first rod 59 forming the upper side of the telescopic bar 57 is rotatably connected to the vicinity of the longitudinal leading end portion of the lever member 14, the second rod 60 forming its lower side is rotatably connected to the support member, and the telescopic bar 57 is disposed in the longitudinal direction of the electric actuator 23.

A cylindrical member 61 is fixed at the lower end of the first rod 59, and the cylindrical member 61 has a cylindrical shape and houses the second rod 60 on the inner circumferential side thereof. That is, the telescopic bar 57 is expanded and contracted by sliding of the second rod 60 on the inside of the cylindrical member 61 fixed to the first rod 59.

The lift sensor 58 is a sensor which uses a linear variable differential transformer (LVDT) which measures the displacement of the cylindrical member 61 of the telescopic bar 57 via the lift sensor stays 62 fixed to the upper end of the cylindrical member 61 of the telescopic bar 57. Specifically, the lift sensor 58 has a cylindrical lift sensor body 64 fixed to the support member 56, a core section (not shown) housed in the lift sensor body 64, and a rod-shape shaft section 65 connected to the core section. The shaft section 65 is disposed parallel to an extension direction of the telescopic bar 57, and the upper end of the shaft section 65 is fixed to the lift sensor stays 62.

The lift amount detector 55 is connected to the electronic governor 17, and its output is regulated to detect the lift amount of the regulating valve 13. That is, it is regulated to be able to detect the lift amount. Further, the lift amount is also displayed on an operating panel 34 (see FIG. 1), and it is possible to check the lift amount in the field. Further, the lift amount may also be remotely monitored in, for example, a monitoring center.

(Electronic Governor)

The electronic governor 17 controls the operation of the switching drive mechanism 15. As shown in FIG. 1, a result of the process control performed based on the detection result of the pressure and temperature in the compressor 18 is input to the electronic governor 17. Moreover, the rotational speed of the blade 116 detected by the speed detection sensor 114 forming the turbine body 11 is input to the electronic governor 17. Furthermore, the command from the user input from the operating panel 34 is input to the electronic governor 17. The electronic governor 17 controls the operation of the switching drive mechanism 15, and more particularly, the operation of the electric motor 26 forming the electric actuator 23, based on these inputs.

Figure 8:
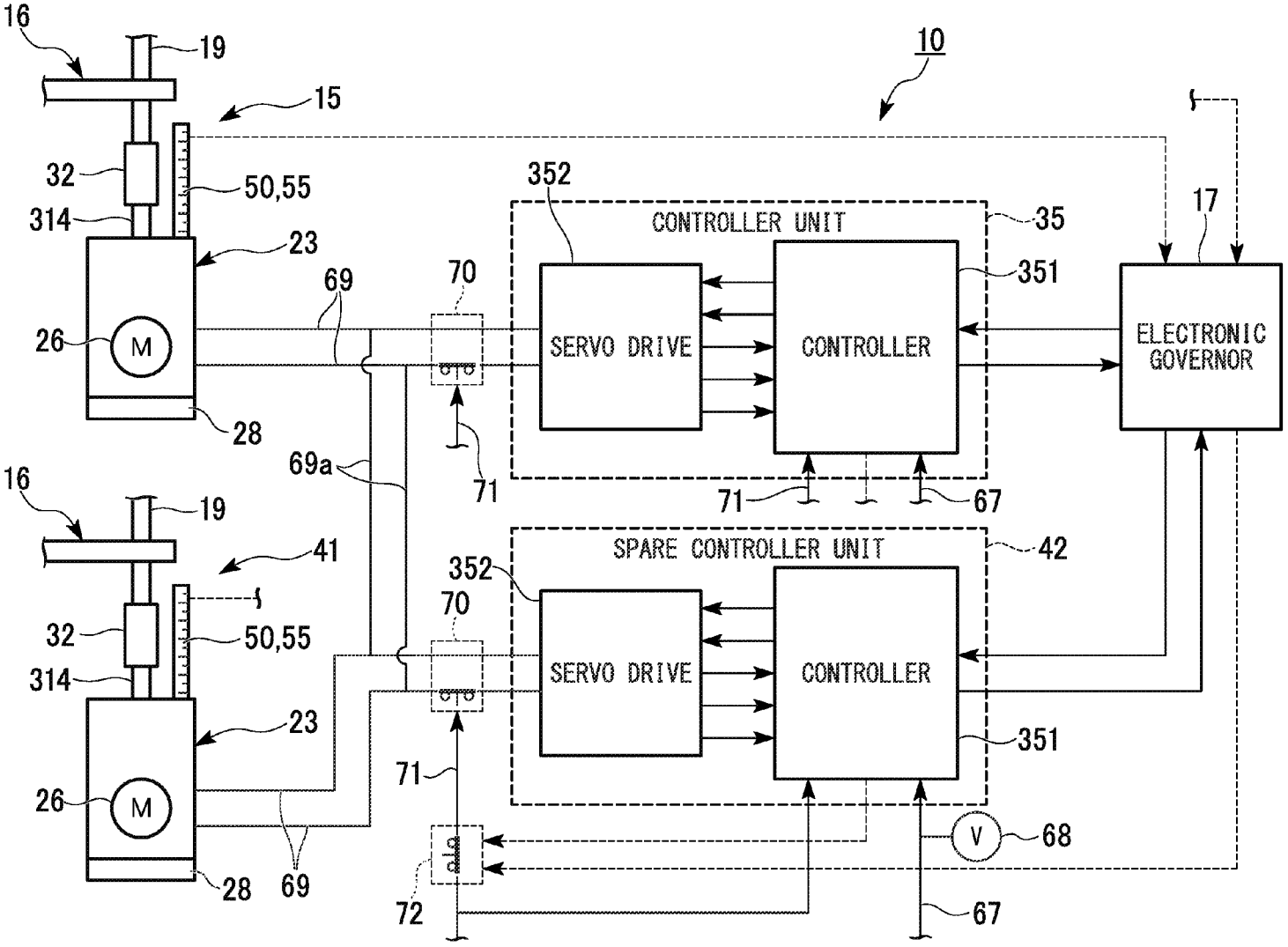
FIG. 8 is a schematic diagram showing control of the electric actuator in the steam turbine according to the first embodiment.

FIG. 8 is a schematic diagram showing control of the electric actuator 23 in the steam turbine 10 according to the first embodiment. In the steam turbine 10 according to this embodiment, the controller unit 35 controls the operation of the electric actuator 23 based on the control of the electronic governor 17. The controller unit 35 has a controller 351 and a servo drive 352.

Also, the controller unit 35 is supplied with main power supply (e.g., AC 230 V) via a power cable 67. The power cable 67 is provided with a voltmeter 68 which measures the power flowing through the power cable 67. The voltmeter 68 is connected to the electronic governor 17, and reports the voltage of the current flowing through the power cable 67 to the electronic governor 17.

According to this construction, the controller 351 issues a command of the rotational speed to the servo drive 352 under the control of the electronic governor 17, and the servo drive 352 gives power to the electric motor 26 via the motor cable 69 based on the command. Meanwhile, the rotational speed, the current value and the temperature of various locations detected in the electric motor 26 are input to the controller 351 via the servo drive 352. Moreover, when an abnormality is detected in the detected values, the controller 351 notifies the electronic governor 17 that a mild or severe breakdown has occurred in the electric motor 26.

Further, the controller unit 35 causes the brake 28 to be controllable via the servo drive 352. As described above, the brake 28 is configured not to exert a braking force in a state in which the power is supplied. The auxiliary power from an uninterruptible power supply (not shown) is supplied to the brake 28 via the auxiliary power cable 71.

In addition, the motor cable 69 is provided with a switch device 70 which can cut off the power flowing through the motor cable 69. The auxiliary power from the uninterruptible power supply is supplied to the switch device 70 via the auxiliary power cable 71. The switch device 70 is set so that it is closed (CLOSE) in a state in which the auxiliary power is supplied, and the power is supplied to the electric motor 26.

In addition, the auxiliary power cable 71 is provided with an auxiliary switch device 72 capable of cutting off the auxiliary power flowing through the auxiliary power cable 71. In addition, the auxiliary power is also supplied to the controller 351.

Further, the steam turbine 10 is provided with a spare switching drive mechanism 41 having the same function as the switching drive mechanism 15, as a means for driving the regulating valve 13. The electric actuator 23 of the spare switching drive mechanism 41 is connected to the servo drive 352 of the controller unit 35 via the motor cable 69.

Furthermore, the steam turbine 10 is also provided with a spare controller unit 42 as well as the controller unit 35, as a means for controlling the operation of the switching drive mechanism 15 or the spare switching drive mechanism 41. The spare controller unit 42 is connected to the electric actuator 23 of the switching drive mechanism 15 and the spare switching drive mechanism 41 via the motor cable 69.

That is, in the steam turbine 10 of this embodiment, the switching drive mechanism 15 and the controller unit 35 are redundant with respect to each other.

Next, the operation of the steam turbine 10 according to the first embodiment of the present invention will be described. In a normal operation state, the steam turbine 10 is driven by using the regulating valve 13 as the switching drive mechanism 15. The switching drive mechanism 15 is controlled by the controller unit 35.

When the electric actuator 23 of the switching drive mechanism 15 breaks down, abnormality of the electric actuator 23 is reported to the controller 351 from the servo drive 352. The controller 351 issues a command to set the switch device 70 and the auxiliary switch device 72 to an open state (OPEN). That is, the auxiliary power supplied to the brake 28 via the auxiliary power cable 71 is cut off, and the power supplied to the electric motor 26 and the brake 28 is cut off. Thus, the electric motor 26 is stopped, and at the same time, the brake 28 is actuated. By actuation of the brake 28, the rotation of the electric motor 26 is braked, and the position of the regulating valve 13 is maintained. That is, the steam turbine 10 is continuously operated without cutting off the steam supplied to the turbine body 11 via the steam flow passage 12.

Similar control is also effective when the controller unit 35 breaks down. That is, when the controller unit 35 breaks down, the controller unit 35 itself can report the command to the auxiliary switch device 72 and can set the auxiliary switch device 72 to the open state.

Furthermore, it is also possible to provide a similar function to the electronic governor 17. That is, the controller unit 35 falls into an uncontrollable state and cannot issue a command to the auxiliary switch device 72, and when the electronic governor 17 becomes aware of the state, the electronic governor 17 is also able to directly command the supply cutoff of the auxiliary power to the auxiliary switch device 72.

When only the electric actuator 23 breaks down, the control of the controller unit 35 is switched to the spare switching drive mechanism 41. That is, the servo drive 352 of the controller unit 35 and the spare switching drive mechanism 41 are connected to each other via a spare motor cable 69*a*, and it is possible to control the spare switching drive mechanism 41 using the controller unit 35.

When the controller unit 35 breaks down, in a state in which the regulating valve 13 is held by the brake 28 of the switching drive mechanism 15, the electric actuator 23 is switched to be controlled by the spare controller unit 42. That is, the electric actuator 23 of the switching drive mechanism 15 and the spare controller unit 42 are connected to each other via the spare motor cable 69*a*, and it is possible to control the electric actuator 23 by the spare controller unit 42.

Meanwhile, when the power supply is stopped due to power failure, the lever member 14 which receives the tensile force of the tension spring 20 rotates in a counter-clockwise direction in FIG. 1, and the regulating valve 13 closes the steam flow passage 12 with this rotation. That is, the operation of the brake 28 is not performed, and a Fail Safe (dual safety system) function which quickly stops the steam turbine 10 in the fully closed state of the regulating valve 13 is applied.

Further, the lift amount of the regulating valve 13 can be monitored by the lift amount detector 55. The electronic governor 17, for example, can maintain the opening degree of the regulating valve 13 using the lift amount detector 55 by actuating the brake 28 when the lift amount is 105%.

Similarly, the electronic governor 17 also monitors the limit switch unit 50, and the electronic governor 17 can maintain the opening of the regulating valve 13 by actuating the brake 28, when the switch of the limit switch unit 50 is input, that is, when the regulating valve 13 exceeds the lift amount of 100%.

According to this embodiment, since the valve opening degree of the regulating valve 13 is maintained even when the electric motor 26 and the controller unit 35 break down, it is possible operate the steam turbine 10 without stopping the operation of the steam turbine 10.

Further, since the power to the brake 28 is supplied by the uninterruptible power supply, it is possible to prevent the brake 28 from being erroneously operated due to power failure.

Also, when the regulating valve 13 is driven to the planned value or higher due to the control abnormality of the controller unit 35, it is possible to prevent the excess steam from flowing into the turbine body 11.

Also, by the simple configuration such as the ball screw 30 and the nut 311, it is possible to convert the rotary motion of the electric motor 26 into the linear motion of the regulating valve 13. Moreover, the installation space can be reduced by the simple configuration of the switching drive mechanism 15.

Moreover, when the switching drive mechanism 15 breaks down, the spare switching drive mechanism 41 drives the regulating valve 13 in place of the switching drive mechanism 15. Thus, since it is possible to continuously operate the steam turbine 10 even when the switching drive mechanism 15 breaks down, the reliability of the steam turbine 10 can be improved.

Moreover, when the controller unit 35 breaks down, the spare controller unit 42 is adapted to control the operation of the switching drive mechanism 15 or the spare switching drive mechanism 41 in place of the controller unit. Thus, since it is possible to continuously operate the steam turbine 10 even when the controller unit 35 breaks down, the reliability of the steam turbine 10 can be further improved.

Further, in the steam turbine 10 according to the first embodiment, as the switching drive mechanism 15 which drives the regulating valve 13, the electric actuator 23 which uses the electric motor 26 as a driving source is used. Thus, there is no need for a conventionally used hydraulic servo mechanism to drive the regulating valve 13, and there is no need for means for preventing the leakage of the hydraulic oil. Furthermore, since there is no need for an actuator which supplies hydraulic oil or a sealing valve mechanism, it is not necessary to utilize the upper space of the bearing cover 24 as the installation space of the switching drive mechanism 15. This enables labor required for maintenance of the bearing 112 to be reduced without requiring detachment of the switching drive mechanism 15 from the top of the bearing cover 24 each time the maintenance of the bearing 112 is performed.

Moreover, since it is possible to use only the bearing 112, the hydraulic oil can be set to a relatively low pressure. Thus, there is no need for a large output of the pump or motor, and it is possible to reduce the size of the oil console.

Further, in the steam turbine 10 according to the first embodiment, as indicated by the broken line in FIG. 4, the electric actuator 23 is in a state in which slight rotation is permitted. This serves to release the horizontal force acting on the electric actuator 23, that is, the force in a direction substantially perpendicular to the axial direction of the ball screw 30. In more detail, since the lever member 14 shown in FIG. 1 rotates based on the proximal end portion as a supporting point, the leading end portion draws an arc trajectory. Therefore, the lever side rod 19 fixed to the lever member 14 and the actuator side rod 314 connected thereto also draw an arc trajectory rather than the simple linear motion in the axial direction. Therefore, the rotation of the electric actuator 23 is allowed to release the force acting in the lateral direction, thereby preventing the occurrence of breakdowns or the like.

Also, in the steam turbine 10 according to the first embodiment, the lever side rod 19 and the actuator side rod 314 are connected to each other via the coupling 32 in a detachable manner, and it is possible to immovably lock the lever side rod 19 using the lock mechanism 16.

According to such a configuration, when breakdown or the like occurs in the electric actuator 23 and there is a need for replacement, after the lever side rod 19 is locked by the lock mechanism 16 while the steam flow passage 12 is opened by the regulating valve 13, the connection between the lever side rod 19 and the actuator side rod 314 is released by disconnecting the coupling 32. Accordingly, it is possible to perform the replacement or repairing work by detaching the electric actuator 23, while continuing the operation of the turbine body 11.

Modified Example

Figure 9:
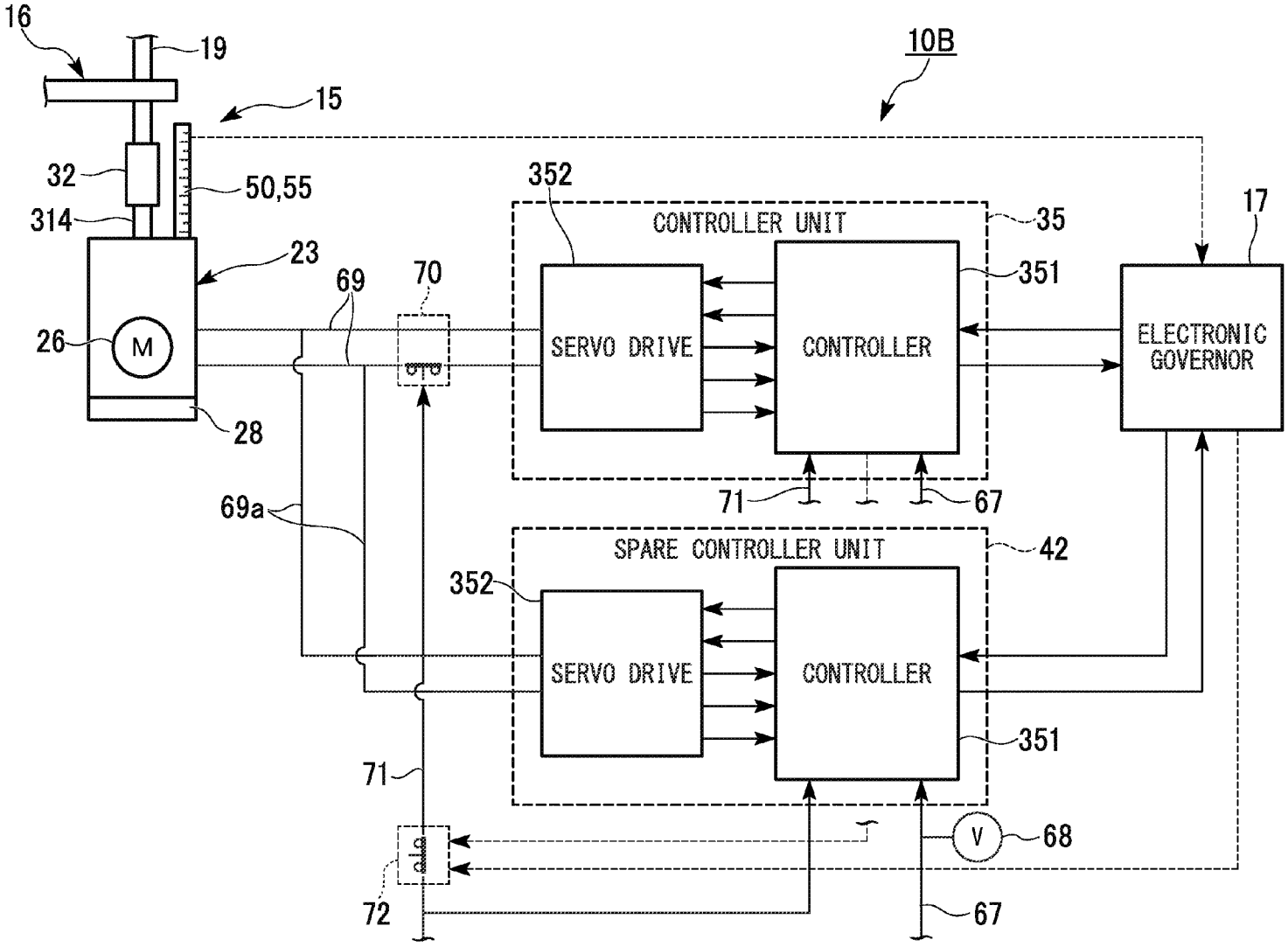
FIG. 9 is a schematic diagram showing control of the electric actuator in the steam turbine according to a modified example of the first embodiment.

Next, a steam turbine 10B of a first modified example will be described. FIG. 9 is a schematic diagram showing control of the electric actuator 23 in the steam turbine 10B of the first modified example. The steam turbine 10B of the first modified example is different from the steam turbine 10 shown in FIG. 8 in that the spare switching drive mechanism 41 is not provided. Since other configurations are the same as the embodiment, they are denoted by the same reference numerals as in FIG. 1, and a description thereof will not be provided.

According to the steam turbine 10B of the first modified example, when the switching drive mechanism 15 breaks down, the state of the regulating valve 13 is maintained by the brake 28. This enables usage without stopping the operation of the steam turbine 10. Further, it is possible to repair and replace the regulating valve 13, while maintaining the switching drive mechanism 15 in the open state.

Meanwhile, when the controller unit 35 breaks down, it is possible to switch the control of the switching drive mechanism 15 to the spare controller unit 42, while maintaining the regulating valve 13 with the brake 28.

Figure 10:
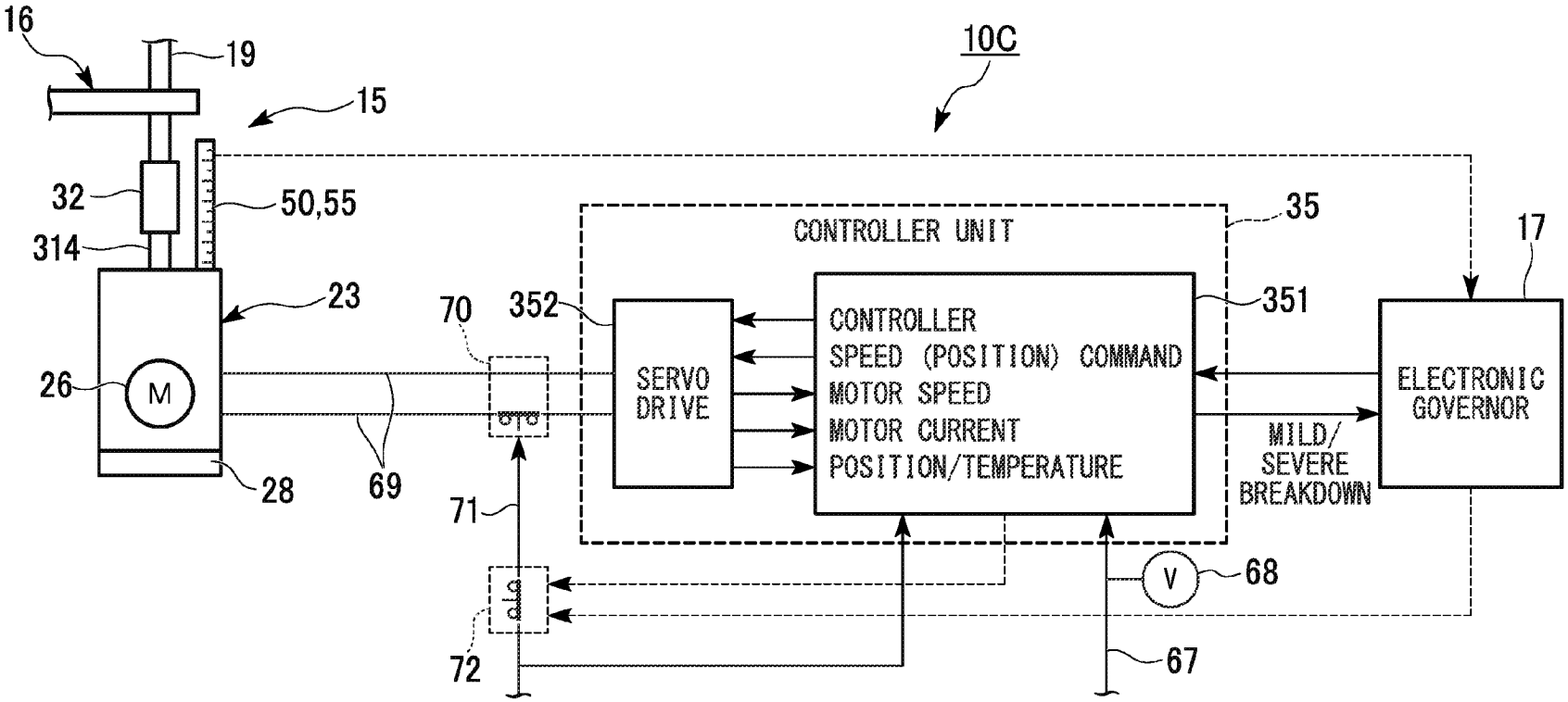
FIG. 10 is a schematic diagram showing control of the electric actuator in the steam turbine according to a modified example of the first embodiment.

Next, a steam turbine 10C of a second modified example will be explained. FIG. 10 is schematic diagram showing control of the electric actuator 23 in the steam turbine 10C of the second modified example. The steam turbine 10C of the second modified example is different from the steam turbine 10 shown in FIG. 8 in that the spare switching drive mechanism 41 and the spare controller unit are not provided.

According to the steam turbine 1 OC of the second modified example, when the switching drive mechanism 15 breaks down, the state of the brake 28 is maintained by the regulating valve 13. This enables usage without stopping the operation of the steam turbine 10. Further, it is possible to repair and replace the switching drive mechanism 15 while maintaining the regulating valve 13 in the open state.

Even when the controller unit 35 breaks down, it is possible to repair and replace the controller unit 35 while maintaining the state of the regulating valve 13.

The various shapes and combinations of the components and the operation procedures shown in the above-described embodiment and modified example are examples, and various modifications can be made based on design requirements or the like without departing from the scope of the present invention.

REFERENCE SIGNS LIST

10, 10B, 10C Steam turbine
11 Turbine body
12 Steam flow passage
13 Regulating valve
14 Lever member
15 Switching drive mechanism
16 Lock mechanism
17 Electronic governor
18 Compressor
19 Lever side rod
20 Tension spring
21 Bracket
22 Holding member
23 Electric actuator
24 Bearing cover
25 Pedestal
26 Electric motor
27 Conversion mechanism
28 Brake
29 Motor housing section
30 Ball screw
31 Piston unit
32 Coupling
33 Pin
34 Operating panel
35 Controller unit
36 Piston casing
37 Piston cap
38 Stopper
39 Guide plate
41 Spare switching drive mechanism
42 Spare controller unit
50 Limit switch unit
52 Limit switch
53 Contact bracket
55 Lift amount detector
57 Telescopic bar
58 Lift sensor
67 Power cable
68 Voltmeter
69 Motor cable
69*a* Spare motor cable
70 Switch device
71 Auxiliary power cable

72 Auxiliary switch device
111 Casing
113 Rotor
121 Steam introduction port
122 Steam supply port
123 Throttle hole
131 Arm member
132 Regulating valve member
161 Support rod
162 Holding plate
162*a* Fitting groove
163 Fixing bolt
164 Pressing member
311 Nut
312 Piston rod
313 Rod end connector
314 Actuator side rod
315 Fixing bolt
322 Rod insertion hole
351 Controller
352 Servo drive

What is claimed is:

1. A steam turbine comprising:
a turbine body having a rotatably supported blade;
a steam flow passage which is connected to the turbine body and through which steam flows as a working fluid;
a regulating valve which regulates opening and closing of the steam flow passage with a linear motion;
a switching drive mechanism which drives the regulating valve;
an electronic governor which controls at least the switching drive mechanism; and
a controller unit which controls the operation of the switching drive mechanism,
wherein the switching drive mechanism comprises:
an electric motor which rotates when supplied with power;
a conversion mechanism which converts a rotary motion of the electric motor into a linear motion of the regulating valve; and
a brake which brakes the rotary motion of the electric motor, and
at least one of the controller unit and the electronic governor performs control such that the brake is actuated and the rotary motion of the electric motor is braked to maintain the position of the regulating valve when at least one of the electric motor and the controller unit breaks down.

2. The steam turbine of claim 1, wherein the brake is configured to be supplied with power by an uninterruptible power supply and to be actuated by cutoff of the power supplied to the brake to brake the rotary motion of the electric motor, and
at least one of the controller unit and the electronic governor cuts off the power supplied to the brake when at least one of the electric motor and the controller unit breaks down.

3. The steam turbine of claim 1, further comprising:
a limit sensor which detects driving of the regulating valve in excess of a predetermined range,
wherein at least one of the controller unit and the electronic governor performs control such that the brake is actuated and the rotary motion of the electric motor is braked to maintain the position of the regulating valve, when the limit sensor detects driving of the regulating valve in excess of a predetermined range.

4. The steam turbine of claim 1, further comprising:
a limit member which mechanically limits the driving of the regulating valve.

5. The steam turbine of claim 1, wherein the conversion mechanism comprises:
a ball screw which is rotationally driven by the electric motor; and
a nut which is screwed to the ball screw and is connected to the regulating valve.

6. The steam turbine of claim 1, further comprising:
a spare controller unit which controls the operation of the switching drive mechanism when the controller unit breaks down.

7. The steam turbine of claim 1, further comprising:
a spare switching drive mechanism which drives the regulating valve when the switching drive mechanism breaks down.

8. The steam turbine of claim 1, wherein breakdown of at least one of the electric motor and the controller unit is detected by the electronic governor.

9. The steam turbine of claim 2, further comprising:
a limit sensor which detects driving of the regulating valve in excess of a predetermined range,
wherein at least one of the controller unit and the electronic governor performs control such that the brake is actuated and the rotary motion of the electric motor is braked to maintain the position of the regulating valve, when the limit sensor detects driving of the regulating valve in excess of a predetermined range.

10. The steam turbine of claim 2, further comprising:
a limit member which mechanically limits the driving of the regulating valve.

11. The steam turbine of claim 3, further comprising:
a limit member which mechanically limits the driving of the regulating valve.

12. The steam turbine of claim 2, wherein the conversion mechanism comprises:
a ball screw which is rotationally driven by the electric motor; and
a nut which is screwed to the ball screw and is connected to the regulating valve.

13. The steam turbine of claim 3, wherein the conversion mechanism comprises:
a ball screw which is rotationally driven by the electric motor; and
a nut which is screwed to the ball screw and is connected to the regulating valve.

14. The steam turbine of claim 4, wherein the conversion mechanism comprises:
a ball screw which is rotationally driven by the electric motor; and
a nut which is screwed to the ball screw and is connected to the regulating valve.

15. The steam turbine of claim 2, further comprising:
a spare controller unit which controls the operation of the switching drive mechanism when the controller unit breaks down.

16. The steam turbine of claim 3, further comprising:
a spare controller unit which controls the operation of the switching drive mechanism when the controller unit breaks down.

17. The steam turbine of claim 4, further comprising:
a spare controller unit which controls the operation of the switching drive mechanism when the controller unit breaks down.

18. The steam turbine of claim 5, further comprising:

a spare controller unit which controls the operation of the switching drive mechanism when the controller unit breaks down.

19. The steam turbine of claim 2, further comprising:

a spare switching drive mechanism which drives the regulating valve when the switching drive mechanism breaks down.

20. The steam turbine of claim 3, further comprising:

a spare switching drive mechanism which drives the regulating valve when the switching drive mechanism breaks down.

* * * * *